US006488005B2

(12) United States Patent
Kim

(10) Patent No.: US 6,488,005 B2
(45) Date of Patent: Dec. 3, 2002

(54) SYSTEM AND A METHOD FOR RUNNING A DIESEL ENGINE WHEN STARTING A VEHICLE

(75) Inventor: Young-Jae Kim, Seoul (KR)

(73) Assignee: Hyundai Motor Co., Seoul (KR)

( * ) Notice: Subject to any disclaimer, the term of this patent is extended or adjusted under 35 U.S.C. 154(b) by 0 days.

(21) Appl. No.: 09/953,975

(22) Filed: Sep. 18, 2001

(65) Prior Publication Data

US 2002/0062815 A1 May 30, 2002

(30) Foreign Application Priority Data

Nov. 24, 2000 (KR) ..... 2000-70244

(51) Int. Cl.[7] ..... F02D 41/00
(52) U.S. Cl. ..... 123/339.16; 123/339.29
(58) Field of Search ..... 477/114, 107; 123/339.16, 339.29, 319, 339.1, 339.14

(56) References Cited

U.S. PATENT DOCUMENTS 5,366,424 A * 11/1994 Wataya ..... 123/336
6,055,476 A * 4/2000 Yoshino ..... 123/339.16

* cited by examiner

*Primary Examiner*—Bibhu Mohanty
(74) *Attorney, Agent, or Firm*—Birch, Stewart, Kolasch & Birch, LLP

(57) ABSTRACT

The present invention provides a system for running a diesel engine comprising an idle speedup switch, an uphill slope sensor, an accelerator pedal sensor, control means increasing an idle speed, when the idle speedup switch is on or the accelerator pedal is depressed on an uphill slope to start movement of a vehicle in an idle state, to a predetermined level greater than a given idle speed such that an amount of air supply increases and operating the engine in accordance with the increased amount of air supply, and a turbocharger providing air to the engine. A method for running the diesel engine is also provided, the method comprising the steps of determining whether the idle speedup switch is on in the idle state, determining whether the vehicle is stopped on an uphill slope in the idle state, increasing an idle speed to the predetermined level greater than the given idle speed such that an amount of air supply increases if the accelerator pedal is depressed when the idle speedup switch is on or the vehicle is stopped on an uphill slope in an idle state, and operating the engine in accordance with the increased amount of sir supply.

3 Claims, 2 Drawing Sheets

SYSTEM AND A METHOD FOR RUNNING A DIESEL ENGINE WHEN STARTING A VEHICLE

CROSS-REFERENCE TO RELATED APPLICATION

This application claims priority of Korea patent Application No. 10-2000-0070244, filed on Nov. 24, 2000.

BACKGROUND OF THE INVENTION (a) Field of the Invention

The present invention relates to diesel engines, and more particularly, to a method and a system for reducing turbo-lag in diesel engines and thereby increasing engine power.

(b) Description of the Related Art

Generally, a diesel engine is a compression ignition type engine in which highly pressurized fuel is directly injected into a cylinder, and the injected fuel is ignited at a high temperature caused by high compression pressure.

The diesel engine is equipped with a turbocharger which increases the mass of air delivered to the engine combustion chambers to improve engine power and reduce general exhaust gas emissions. However, in this case, the temperature of the combustion chamber rises to a high level and the production of NOx emissions increases.

Recently, to solve the above problems and stably improve engine power, a TCI (turbocharger intercooler) diesel engine has come into use, the intercooler lowering the temperature of the combustion chamber.

In a vehicle using the above diesel engine, if a driver depresses an accelerator pedal to start movement of a vehicle stopped on an uphill slope, fuel injected into the combustion chamber is imperfectly burned, and therefore visible smoke occurs.

Because the diesel engine is a spread ignition type, the mixing state of air and fuel is important, and in the case of a low air-fuel ratio, visible smoke is exhausted. Therefore, when accelerating from a stop rapidly or starting to move a vehicle stopped on an uphill slope, an amount of injected fuel should be decreased. Specially, the TCI diesel engine has a 'turbo-lag' phenomenon in that it takes a certain period of time before the engine speed increases after depressing the accelerator pedal, and therefore engine torque when starting movement is much less than that at full load of the engine. Here, if an amount of fuel injected into the combustion chamber increases, visible smoke occurs.

When starting movement of a vehicle with a TCI diesel engine rapidly or starting a vehicle stopped on an uphill slope, smoke is a factor that limits an increase of injected fuel, so the amount of injected fuel should be restricted regardless of full load power desired. The amount of injected fuel should then be increased to raise engine torque under acceleration, and the amount of air should be increased to correspond to the increase in the amount of injected fuel.

Therefore, to accelerate a vehicle rapidly from a stop or start movement of a vehicle stopped on an uphill slope, the engine idle speed is initially increased, or control for reducing gear-shift shock is eliminated in spite of much visible smoke, or inertia of a fly wheel is increased.

However, the above prior art can't remove the turbo-lag phenomenon of the TCI diesel engine. Moreover, when the engine idle speed is increased to reduce an influence of turbo-lag without replacing vehicle hardware, noise and fuel consumption increase considerably, and when the control for reducing the gear-shift shock is eliminated, the vehicle starts rapidly even on level land with a corresponding increase in smoke, and when the inertia of the fly wheel is increased, components related to the fly wheel should be replaced.

SUMMARY OF THE INVENTION

The present invention has been made in an effort to solve the above problems. It is an object of the present invention to reduce turbo-lag in diesel engine vehicles so that engine power is increased.

A system for running a diesel engine according to the present invention comprises an idle speedup switch, an uphill slope sensor, an accelerator pedal sensor, control means increasing an idle speed to a predetermined level higher than a given idle speed such that an amount of air supply increases and outputting a driving signal in accordance with the increased amount of air supply when the idle speedup switch is on or the accelerator pedal is depressed to start a vehicle stopped on an uphill slope in an idle state, and a turbocharger providing air to the engine. Furthermore, the system according to the present invention comprises a fuel injector that injects fuel to the engine.

Also, the present invention provides a method for running the engine, the method comprising the steps of determining whether the idle speedup switch is on in the idle state, determining whether the vehicle is stopped on an uphill slope in the idle state, increasing an idle speed to the predetermined level higher than the given idle speed such that an amount of air supply increases if the accelerator pedal is depressed when the vehicle is stopped on an uphill slope or the idle speedup switch is on in the idle state, and operating the engine by injecting fuel corresponding to the increased amount of air into the combustion chamber.

DETAILED DESCRIPTION OF THE PREFERRED EMBODIMENTS

Hereinafter, a preferred embodiment of the present invention will be described in detail with reference to the accompanying drawings.

Figure 1:
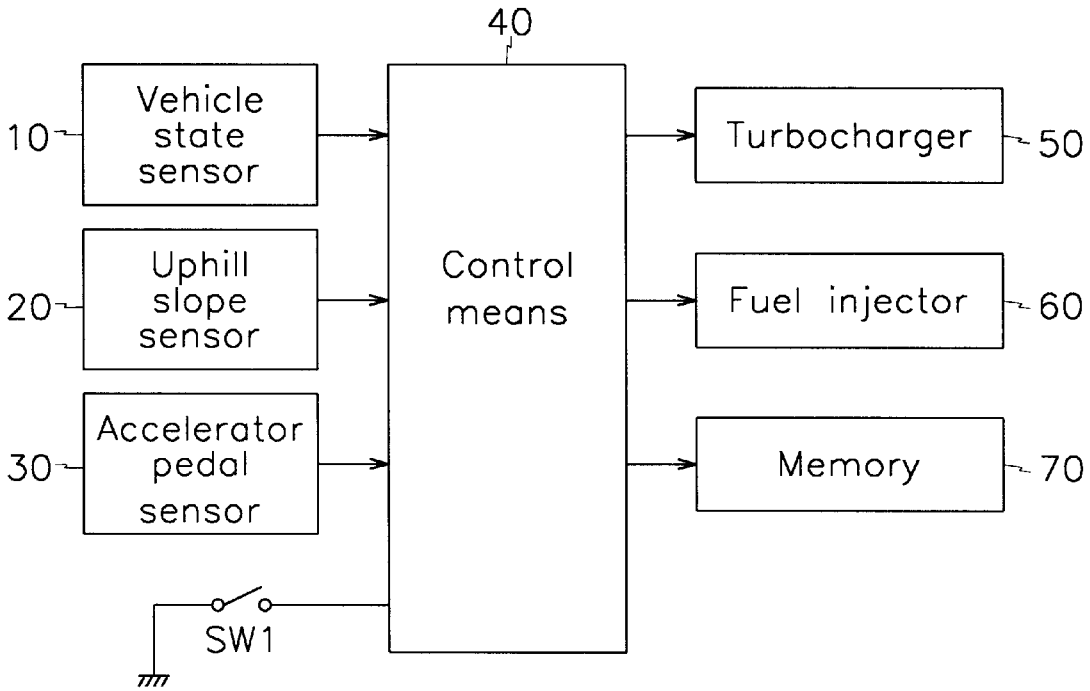
FIG. 1 is a block diagram of a system for running a diesel engine in starting according to the present invention.

FIG. 1 is a block diagram of a system for running a diesel engine in starting according to the present invention.

As shown in FIG. 1, the system for running a diesel engine according to the preferred embodiment of the present invention comprises a vehicle state sensor 10, an uphill slope sensor 20, an accelerator pedal sensor 30 detecting whether the accelerator pedal is depressed, an idle speedup switch SW1, control means 40, a turbocharger 50, and a fuel injector 60.

The system further comprises a memory 70 (for example, EEPROM) that has a smoke limit table where the maximum amount of fuel that can be burned without generating visible smoke is stored regarding each amount of air supply at each engine speed.. Also, the control means 40 determines the driving state with reference to several signals fed from the sensors (10, 20, and 30) and therewith judges an amount of fuel, and thereby operates the fuel injector 60.

The vehicle state sensor 10 comprises an engine speed sensor, a clutch operation sensor, a brake pedal operation sensor, a coolant temperature sensor, a vehicle speed sensor, a battery state sensor and the like.

With reference to the above, the system for running a diesel engine according to the present invention will be explained in detail.

Figure 2:
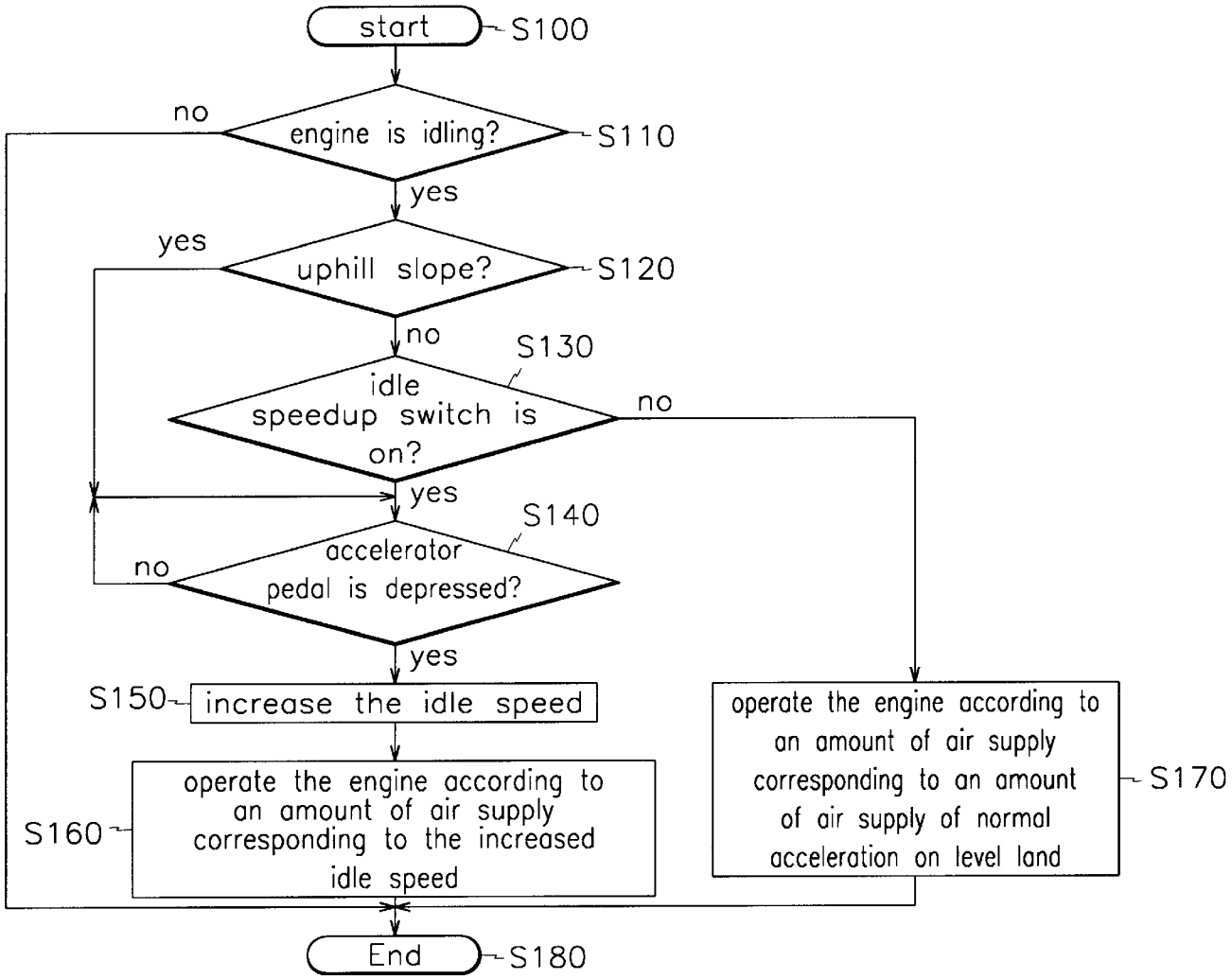
FIG. 2 is a flow chart showing a method for running a diesel engine in starting according to the present invention.

FIG. 2 is a flow chart showing a method for running a diesel engine in starting according to the present invention.

A current is applied to electric devices (for example, several sensors and control means) by manipulating a start key. Then, if the engine is started, the vehicle state sensor 10 feeds vehicle state data into the control means 40, and the control means 40 operates the engine based on a predetermined program by the data provided from the vehicle state sensor 10.

The control means 40 determines whether the engine is idling on the basis of engine speed, states of the brake pedal and the clutch pedal, coolant temperature, vehicle speed and the like (S110). If the engine is determined not to be idling, the procedure ends. If the engine is determined to be idling, the procedure is advanced to step S120, where determination is made as to whether the vehicle is stopped on an uphill slope.

If the vehicle is stopped on an uphill slope, the procedure is advanced to step S140, where determination is made as to whether the accelerator pedal is depressed. Then, if the accelerator pedal is depressed, the procedure is advanced to step S150, where the idle speed is increased.

In step S120, if the vehicle is not stopped on an uphill slope, the procedure is advanced to step S130 where determination is made as to whether the idle speedup switch is on. In the embodiment of the present invention, if a driver pushes an idle speedup button installed in a dashboard or a shift lever with the intention of accelerating the vehicle rapidly, the idle speedup switch is made to be on, and the control means 40 increases the engine idle speed when the accelerator pedal is depressed.

In the case the engine is idling, if the vehicle is determined to be stopped on an uphill slope in step S120, or if the idle speedup switch is determined to be on in step S130, the procedure is advanced to step S140 where determination is made as to whether the accelerator pedal is depressed. And then, if the accelerator pedal is determined to be depressed in step S140, the procedure is advanced to step S150, where the control means increases the idle speed to a value higher than a predetermined idle speed at which the vehicle starts on level land.

The control means operates the engine according to an amount of air supply corresponding to the increased idle speed (S160).

Further, in step S140, if the accelerator pedal is determined not to be depressed, it is repeatedly determined whether the accelerator pedal is depressed.

Concretely, the control means 40 increases the engine idle speed to a value higher than the predetermined idle speed (which can be changeable according to performance of the vehicle or kind of vehicle) such that an amount of air supply increases, and then an amount of fuel that can be burned without generating visible smoke at the increased amount of air supply is obtained from the table of the memory 70. The control means operates the engine according to the modified amount of air supply.

Therefore, an amount of air greater than an amount of air supply needed for normal starting is supplied to the combustion chamber through the turbocharger. Consequently, an amount of fuel is increased according to the amount of air supply, and therefore the engine power is increased.

By way of example, when accelerating a vehicle rapidly on level land, the idle speed is modified to a speed at which an amount of fuel equivalent to that of 1000 RPM at a full load can be burned without generating visible smoke.

In a 2000 cc class engine, if the idle speed is set at 1000 RPM, 40 $mm^3$/str (stroke) of fuel is supplied with 480 mg/str of air such that an amount of fuel equivalent to that of a full load is burned without generating visible smoke.

Also, in the case the inclination rate of an uphill slope is from 0 to 25%, if the idle speed is modified by increasing linearly within the range of 750~1200 RPM, turbo-lag is prevented and engine power is increased.

Further, in step S130, if the idle speedup switch is determined to be not on, the procedure is advanced to step S170, where if the accelerator pedal is depressed, the engine is operated with an amount of air supply-corresponding to an amount of air supply of normal acceleration on level land.

According to the present invention, because, when a vehicle is accelerated rapidly or is started on an uphill slope, the engine is provided with an amount of air that is greater than that of normal acceleration on level land, and visible smoke and turbo-lag phenomenon are decreased so that the engine power is increased.

Furthermore, gear-shift shock can be decreased, a beginner can more easily start a vehicle on an uphill slope, and climbing performance of a manual transmission vehicle can be increased to a level of that of an automatic transmission vehicle. Also, movement of a vehicle loaded with a heavy cargo can easily be started by pushing the idle speedup button.

Also, because the idle speed is increased only under rapid acceleration and starting out on an uphill slope, unnecessary fuel consumption can be prevented.

While the present invention has been described in detail with reference to the preferred embodiment, those skilled in the art will appreciate that various modifications and substitutions can be made thereto without departing from the sprit and scope of the present invention as set in forth in the appended claims.

What is claimed is:

1. A system for running a diesel engine, which comprises:

an idle speedup switch;

an uphill slope sensor determining whether a vehicle is stopped on an uphill slope;

an accelerator pedal sensor determining whether the accelerator pedal is depressed;

control means, which increases an idle speed to a predetermined level greater than a given idle speed such that an amount of air supply increases and operates the engine in accordance with the increased amount of air supply, if the accelerator pedal is depressed to start movement of the vehicle when, in an idle state, the idle speedup switch is on or a vehicle is stopped on an uphill slope; and a turbocharger providing air to the engine.

2. The system of claim 1 wherein the system further comprises a fuel injector that injects fuel to the engine.

3. A method for running a diesel engine comprising:

determining whether a vehicle is stopped on an uphill slope in the idle state;

determining whether an idle speedup switch is on in an idle state;

increasing an idle speed to a predetermined level greater than a given idle speed such that an amount of air supply increases if an accelerator pedal is depressed to start movement of the vehicle when, in an idle state, an idle speedup switch is on or the vehicle is stopped on an uphill slope; and operating the engine in accordance with the increased amount of air supply.

* * * * *